US006966155B2

(12) United States Patent
Nevison

(10) Patent No.: US 6,966,155 B2
(45) Date of Patent: Nov. 22, 2005

(54) MAT PERIMETER SYSTEM

(76) Inventor: Dale C. H. Nevison, 136 Channelsyde Dr., Algonac, MI (US) 48001

( * ) Notice: Subject to any disclaimer, the term of this patent is extended or adjusted under 35 U.S.C. 154(b) by 0 days.

(21) Appl. No.: 10/811,688

(22) Filed: Mar. 29, 2004

(65) Prior Publication Data

US 2005/0210809 A1 Sep. 29, 2005

(51) Int. Cl.[7] ..... E04F 15/00
(52) U.S. Cl. ..... 52/177; 52/403.1; 52/717.03; 15/238
(58) Field of Search ..... 52/403.1, 177, 52/178, 181, 582.1, 386, 716.1, 717.03, 717.05, 52/179, 578

(56) References Cited

U.S. PATENT DOCUMENTS 4,147,007 A * 4/1979 Eppich ..... 52/570
4,468,910 A * 9/1984 Morrison ..... 52/591

* cited by examiner

*Primary Examiner*—Naoko Slack
(74) *Attorney, Agent, or Firm*—Gregory T. Zalecki

(57) ABSTRACT

A mat perimeter system comprising a mat module, a connector, a resilient border and a resilient corner is disclosed. The mat module has upstanding studs attached on one edge and matching stud receptacles formed into another edge. The studs fit within the stud receptacles allowing the building of a modular mat system. Connectors having two spaced apart rows of studs attached to a base fit within the stud receptacles and allow the creation of another row of studs. Borders and corners fit over the studs to create a desirable perimeter. The studs have locking lips for interlocking with lip recesses formed within the stud receptacles and for interlocking with stud slot lip recesses formed into the borders and corners.

18 Claims, 6 Drawing Sheets

MAT PERIMETER SYSTEM

BACKGROUND

Interlocking modular mats serve a useful purpose. They allow a custom sized mat to be quickly constructed. Current interlocking modular mats have interlocking studs and stud receptacles. Modular mats can be connected to each other by inserting the studs of one mat into the stud receptacles of another mat. Once the custom sized mat is constructed there is a need for borders and corners which can be cost effectively manufactured and securely attached to the mat.

The present invention provides a mat perimeter system comprising a mat module, a connector, a resilient border and a resilient corner which can be cost effectively manufactured. The mat modules, connectors, borders and corners can be tightly secured to each other. The connection strength is further increased by the use of interlocking lips and lip recesses.

SUMMARY

The mat perimeter system addresses these problems. The mat perimeter system is comprised of a mat, a connector, a resilient border and a resilient corner.

The mat has a stud edge and a stud receptacle edge. The stud edge has a plurality of upstanding studs attached to it. The studs form a row. The stud receptacle edge has a plurality of stud receptacles formed within it. The studs are shaped and spaced to engagingly fit within the stud receptacles of a similarly configured mat. Preferably, at least one of the upstanding studs has a locking lip and at least one of the stud receptacles has a lip recess shaped to interlock with the locking lip of that upstanding stud or a similarly shaped upstanding stud.

The connector has two spaced apart rows of upstanding studs attached to a base. The studs of each row are shaped and spaced to engagingly fit within the stud receptacles of the mat. When the studs of one row of the connector are fit within the stud receptacles of the mat a row of upstanding studs is created adjacent to the stud receptacle edge of the mat.

The resilient border is comprised of a border body having a stud slot. The stud slot is shaped to engagingly received and retained a row of upstanding studs. The resilient border has a downwardly tapered top surface.

The resilient corner is comprised of two branches connected at a right angle. Each branch has a stud slot shaped to receive and retain a plurality of linearly aligned upstanding studs. Each branch has a downwardly tapered top surface.

Preferably, the resilient border stud slot has a lip recess shaped to interlock with locking lips of upstanding studs and the resilient corner stud slots have a lip recess shaped to interlock with locking lips of upstanding studs. In use the resilient border and the resilient corner are oriented to be attached to upstanding studs attached to the mat. When attached in this orientation the heights of the resilient border and the resilient corner are less than or equal to the thickness of the mat.

The mat as described can function as an interlocking mat module. The studs of one module fit within the stud receptacles of another module. Mats of varying sizes can be assembled by interlocking the studs of one module with the receptacles of another module. The perimeter of the assembled mat will consist of rows of studs or rows of stud receptacles. The stud receptacles are shaped to receive studs from a connector or another mat module.

DRAWINGS

These and other features, aspects, and advantages of the present invention will become better understood with regard to the following description, appended claims, and accompanying drawings where:

DESCRIPTION

Figure 1:
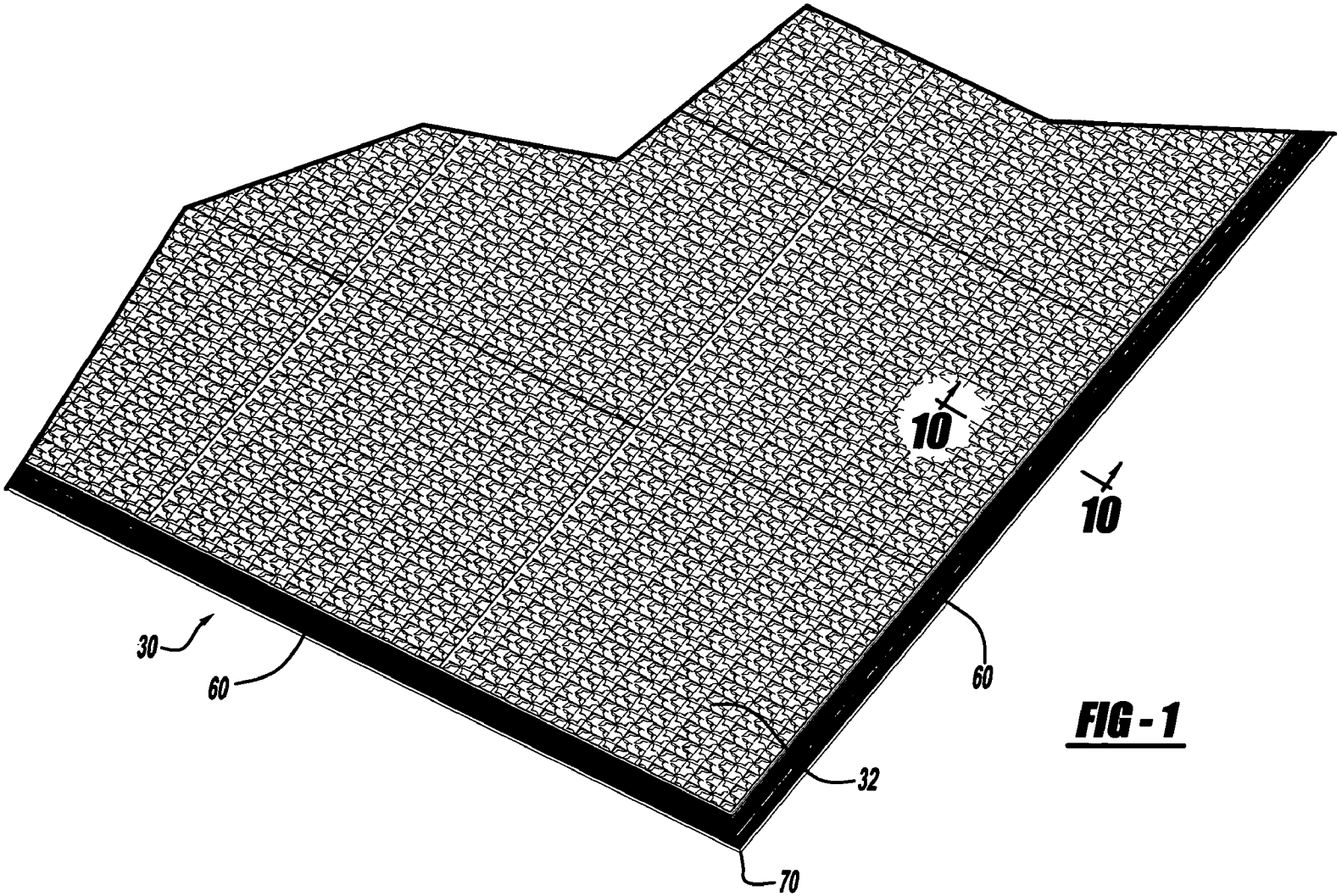
FIG. 1 is a perspective view of a mat perimeter system.

The preferred embodiment of a mat perimeter system 30 is comprised of a mat module 32, a connector 52, a resilient border 60 and a resilient corner 70.

Figure 5:
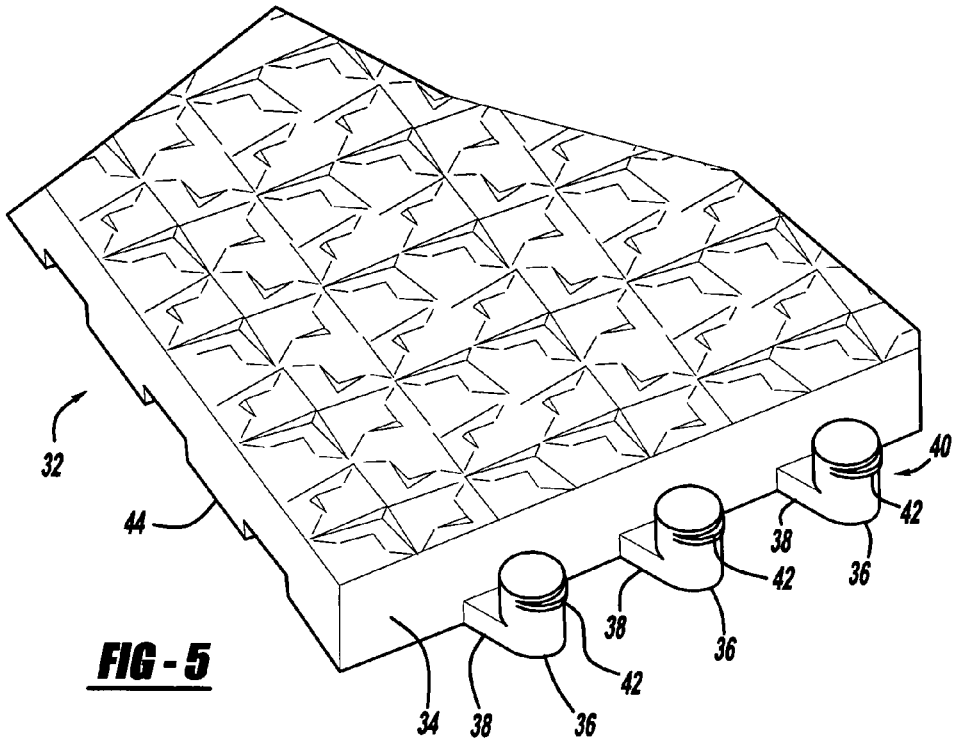
FIG. 5 is a perspective view of a mat module.
Figure 6:
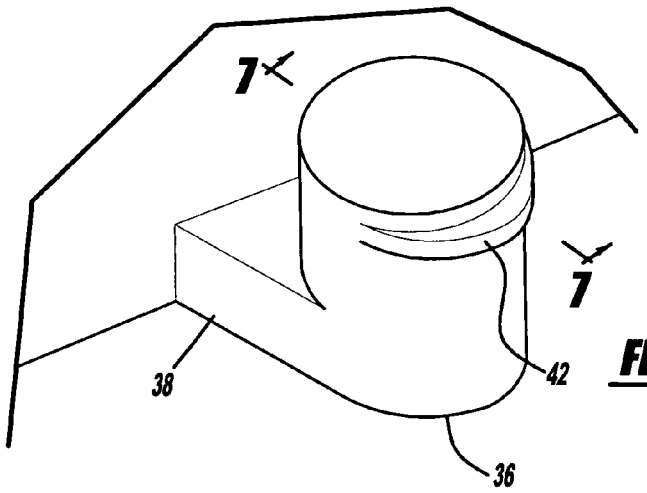
FIG. 6 is a broken away fragmentary perspective view of an upstanding stud attached to the mat module of FIG. 5.
Figure 7:
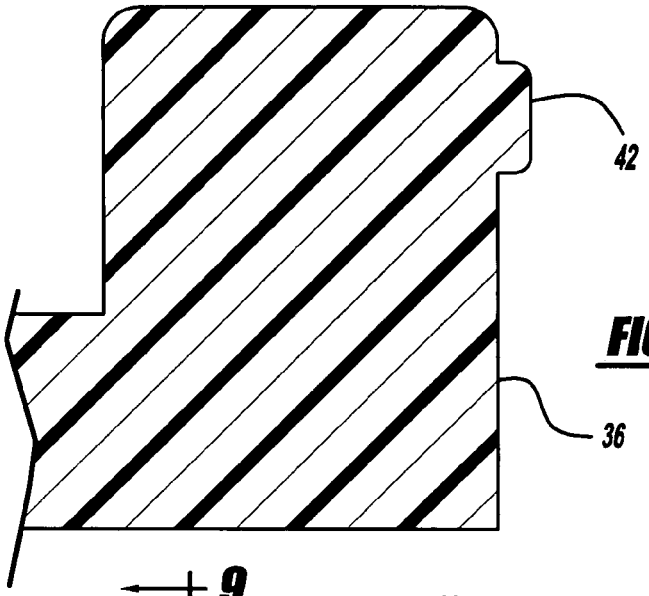
FIG. 7 is a side elevation sectional view of the upstanding stud shown in FIG. 6.
Figure 8:
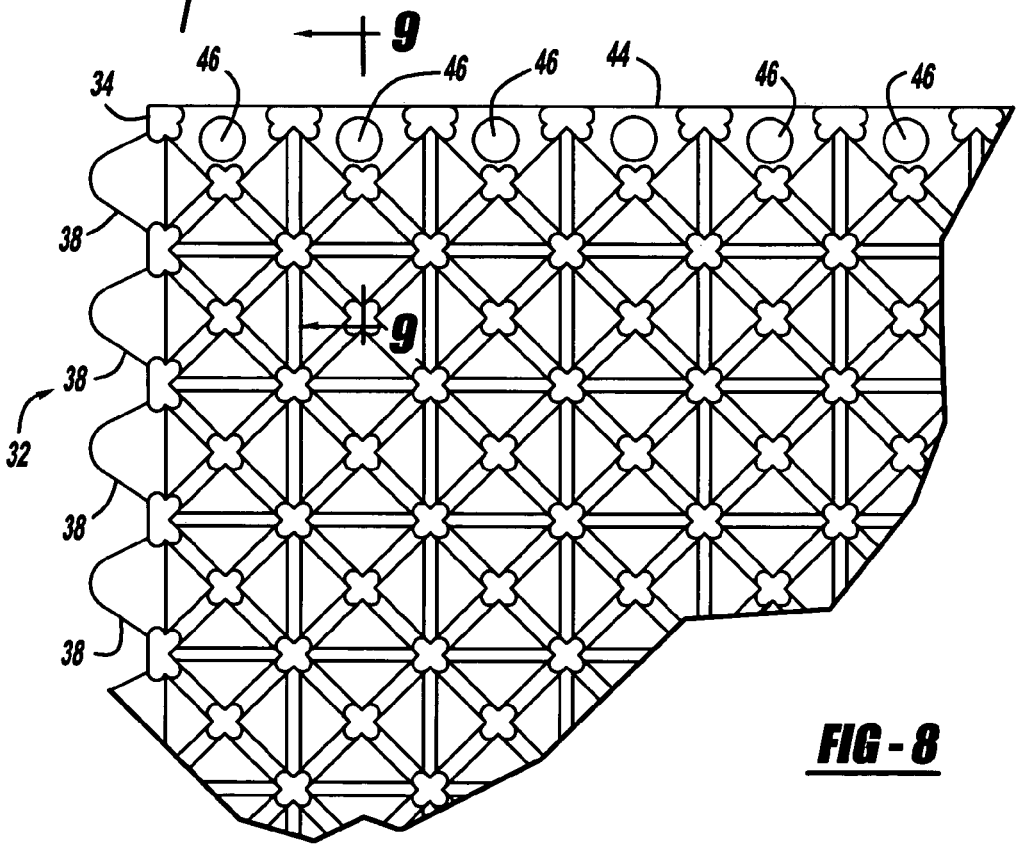
FIG. 8 is a bottom plan view of the mat module shown in FIG. 2.
Figure 9:
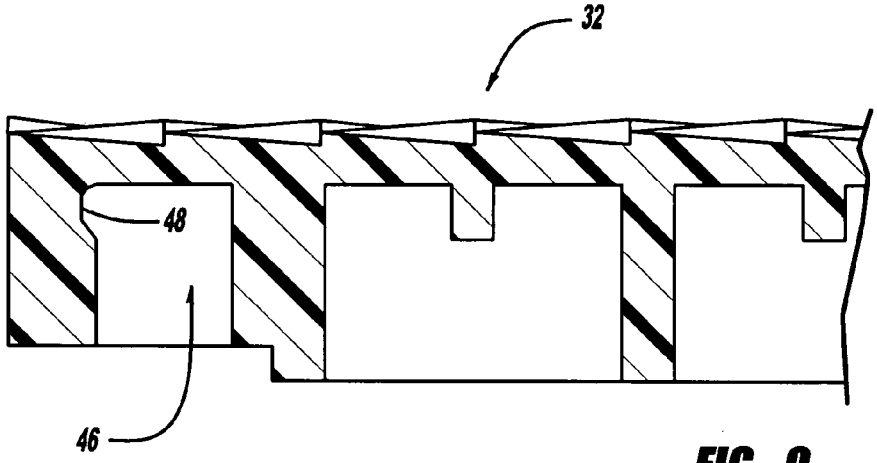
FIG. 9 is a side elevation sectional view of the mat module shown in FIG. 8.
Figure 10:
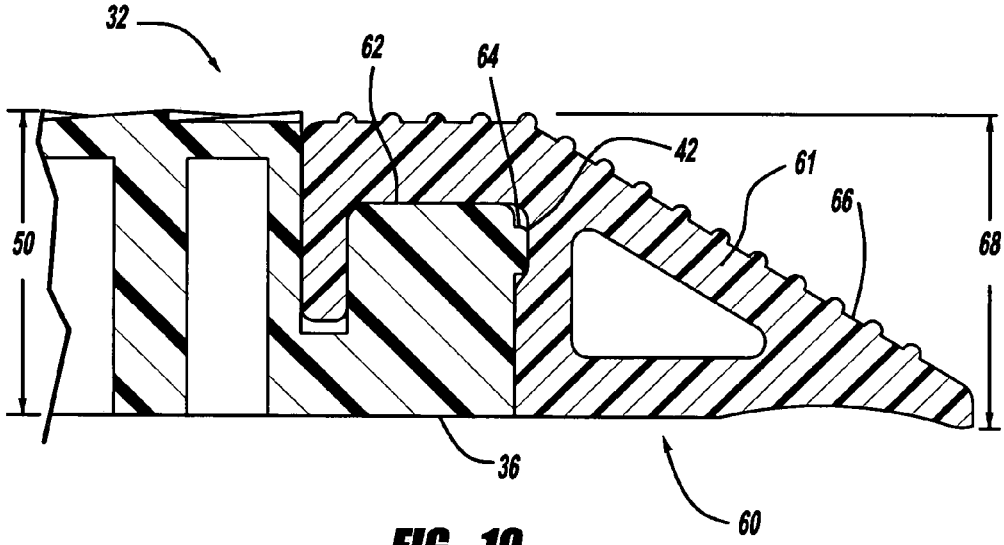
FIG. 10 is a side elevation sectional view of a border connected to a mat module shown in FIG. 1.

Preferably, the mat module 32 is molded from rubber. It has a stud edge 34 and a stud receptacle edge 44. The stud edge 34 has a plurality of upstanding studs 36 attached to it. A base 38 connects each upstanding stud 36 to the stud edge 34 of the mat module 32. The upstanding studs 36 are aligned in a row 40. Each stud 36 should have a uniform cross sectional shape along its longitudinal axis, such as the cylindrical shape of the studs 36 shown in FIG. 5 and FIG. 6. The stud receptacle edge 44 has a plurality of stud receptacles 46 formed therein. The upstanding studs 36 are shaped and spaced to fit within the stud receptacles 46 of a similarly configured mat module 32. The shape, form and alignment of the upstanding studs 36 and the stud receptacles 46 allow the mat modules 32 to be connected to each other, as well as to resilient borders 60 and resilient corners 70. Preferably the upstanding studs 36 have locking lips 42 and the stud receptacles 46 have lip recesses 48. The locking lips 42 should partially surround the studs 36, as shown in FIG. 5 and FIG. 6. The locking lips 42 and lip recesses 48 are shaped and sized to interlock with each other. The lip recesses 48 should be shaped to interlock with the partially surrounding locking lips 42 of the upstanding studs 36, as shown in FIG. 9.

Figure 2:
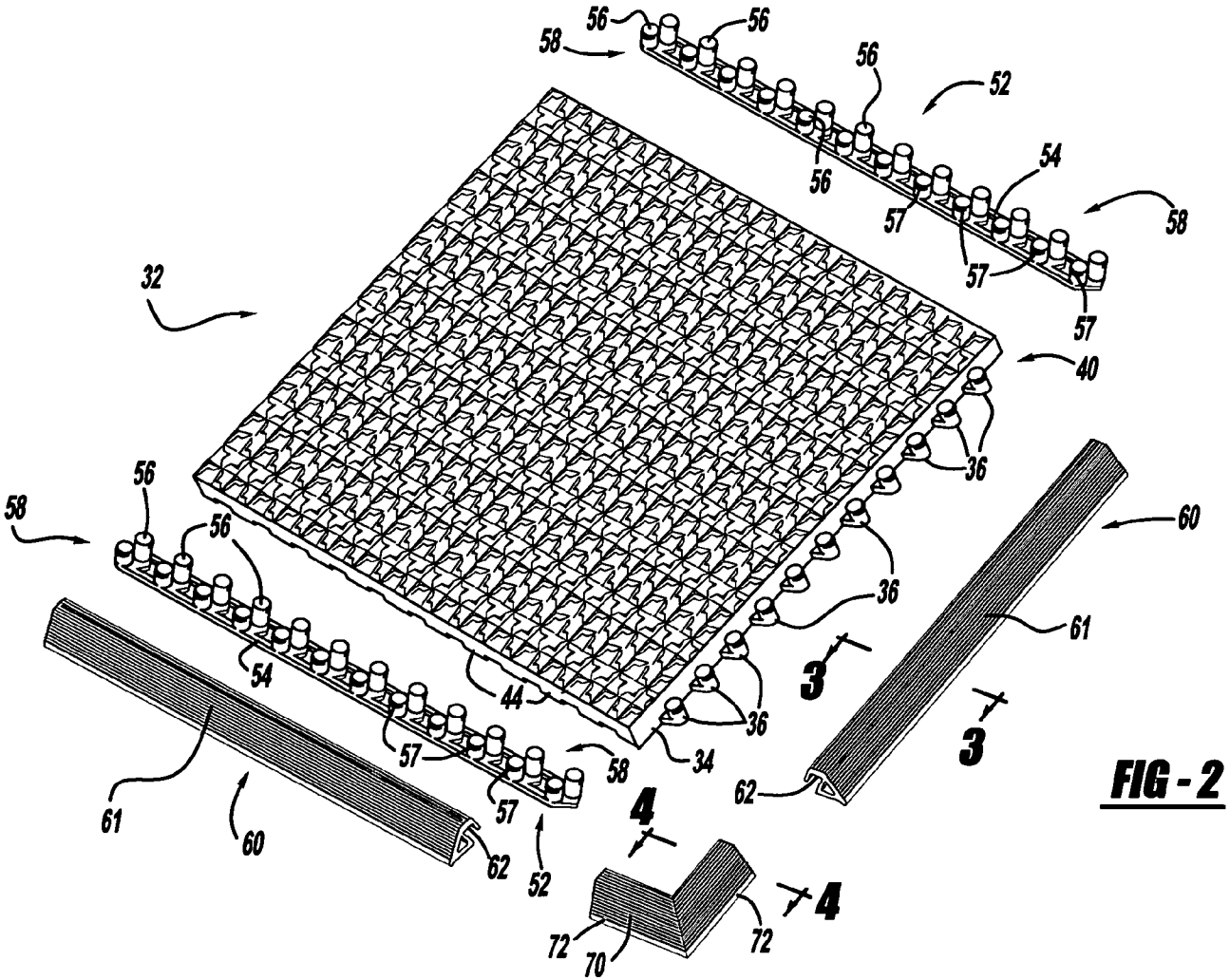
FIG. 2 is a perspective view of one mat module showing broken away connectors, borders and a corner.
Figure 3:
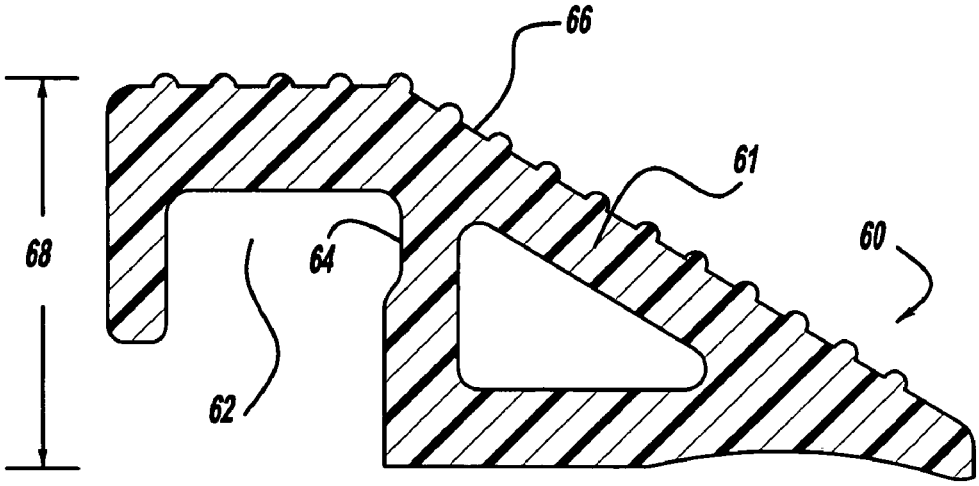
FIG. 3 is a side elevation sectional view of one of the borders shown in FIG. 2.
Figure 4:
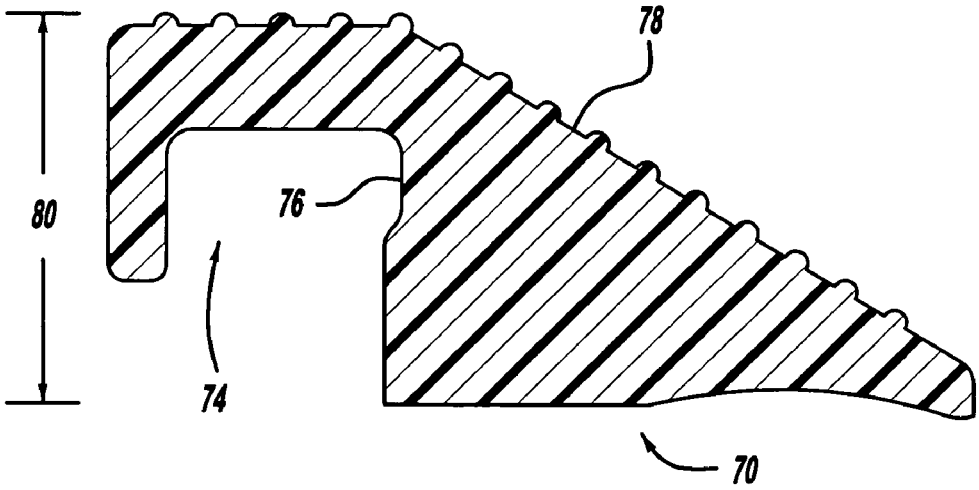
FIG. 4 is a side elevation sectional view of the corner shown in FIG. 2.

The connector 52 has two spaced apart parallel rows 58 of upstanding studs 56, as shown in FIG. 2. The connector 52 is molded from rubber. The rows 58 are connected to each other by a base 54. The upstanding studs 56 of each row 58 are shaped, sized and spaced to engagingly and securely fit within the stud receptacles 46 of the mat module 32, such that lateral movement between the mat module 32 and the connector studs 56 is prevented. Each connector stud 56 should have a uniform cross sectional shape along its longitudinal axis, such as the cylindrical shape of the studs 56 shown in FIG. 2. When one row 58 of upstanding connector studs 56 are inserted into the stud receptacles 46 of a mat module 32 an additional row of upstanding studs 56 is created adjacent to the stud receptacle edge 44 of the mat module 32. Preferably, the upstanding studs 56 have locking lips 57 shaped and sized to interlock with the stud receptacle lip recesses 48 of the mat module 32, as well as the stud slot lip recess 64 of a resilient border 60 and the stud slot lip recess 76 of a resilient corner 70. The locking lips 57 of the studs 56 should partially surround the studs 56 to which they are attached, as shown in FIG. 2.

The resilient border 60 is preferably extruded from vinyl. This allows for a more cost effective fabrication of resilient borders 60 as compared to molding or die casting. It further permits the addition of a coloring dye to the raw vinyl before it is extruded. The border is comprised of a border body 61. The border body 61 is shaped to form a desirable mat border. A stud slot 62 is formed into the border body 61. It is sized and shaped to engagingly receive and retain a row 40, 58 of upstanding studs 36, 56. It can be easily press fit over a row of studs 40, 58. It can be slid along the edge of the mat module 32 while the studs 36, 58 remain engaged with the studs slot 62. Preferably, the stud slot 62 has a stud slot lip recess 64 shaped to interlock with the locking lips 42, 57 of upstanding studs 36, 56. The interlocking lips 42, 57 and stud slot lip recess 64 allow the resilient border to be more securely attached to upstanding studs 36. The resilient border 60 has a downwardly tapered top surface 66 for creating a desirable mat perimeter.

The resilient corner 70 is preferably molded from rubber. It has two branches 72 connected at a right angle. Each branch 72 has a stud slot 74. The stud slot 74 is shaped to receive and retain a plurality of linearly aligned upstanding studs 36, 56. Each branch 72 has a downwardly tapered top surface 78. Preferably, the resilient corner 70 stud slots 74 have a lip recess 76 shaped to interlock with locking lips 42, 57 of upstanding studs 36, 56. Resilient borders 60 are placed along the edges of the mat. The resilient corners 70 are placed at the corners of the mat. The resilient corners 70 trap the borders 60 securely into place so that the borders 60 do not slide along the studs 36, 56 during use of the mat.

The mat module 32 has a height 50. Similarly, the resilient border 60 has a height 68 when oriented for usage and the resilient corner 70 has a height 80 when oriented for usage. Preferably, the border height 68 and the corner height 80 are less than or equal to the thicknesses 50 of the mat module 32. This will prevent users from tripping at the perimeter of the mat perimeter system 30.

What is claimed is:

1. A mat perimeter system comprising:

(a) a mat module having a stud edge with a plurality of upstanding studs forming a row attached thereto and a stud receptacle edge having a plurality of stud receptacles formed therein, wherein the studs are shaped and spaced to engagingly fit within the stud receptacles of a similarly configured mat;

(b) a connector having two spaced apart rows of upstanding studs attached to a base, wherein the studs of each row are shaped and spaced to engagingly fit within the stud receptacles of the mat, for creating a row of upstanding studs adjacent to the stud receptacle edge of the mat; and (c) a resilient border comprising a border body having a stud slot shaped to engagingly receive and retain a row of upstanding studs, said resilient border having a downwardly tapered top surface.

2. The mat perimeter system of claim 1, further comprising a resilient corner comprising two branches connected at a right angle, wherein each said branch has a stud slot shaped to receive and retain a plurality of linearly aligned upstanding studs and wherein each said branch has a downwardly tapered top surface.

3. The mat perimeter system of claim 1, wherein at least one of the upstanding studs has a locking lip and the resilient border stud slot has a lip recess shaped to interlock with locking lips of upstanding studs.

4. The mat perimeter system of claim 2, wherein at least one of the upstanding studs has a locking lip, the resilient border stud slot has a lip recess shaped to interlock with locking lips of upstanding studs and the resilient corner stud slots have a lip recess shaped to interlock with locking lips of upstanding studs.

5. The mat perimeter system of claim 1, wherein the height of the resilient border, when oriented to be attached to upstanding studs attached to the mat, is less than or equal to the thickness of the mat.

6. The mat perimeter system of claim 2, wherein the heights of the resilient border and the resilient corner, when oriented to be attached to upstanding studs attached to the mat, are less than or equal to the thickness of the mat.

7. The mat perimeter system of claim 3, wherein the height of the resilient border, when oriented to be attached to upstanding studs attached to the mat, is less than or equal to the thickness of the mat.

8. The mat perimeter system of claim 4, wherein the heights of the resilient border and the resilient corner, when oriented to be attached to upstanding studs attached to the mat, are less than or equal to the thickness of the mat.

9. An interlocking mat module comprising a mat having a stud edge with a plurality of upstanding studs forming a row attached thereto and a stud receptacle edge having a plurality of stud receptacles formed therein, wherein the studs are shaped and spaced to engagingly fit within the stud receptacles of a similarly configured mat, at least one of the upstanding studs has a locking lip partially surrounding the stud and wherein at least one stud receptacle has a lip recess shaped to interlock with partially surrounding locking lips of upstanding studs.

10. A connector for use on a mat having a stud receptacle edge having a plurality of stud receptacles formed therein, wherein at least one of the stud receptacles has a lip recess shaped to interlock locking lips of upstanding studs, said connector comprising two spaced apart parallel rows of upstanding studs attached to a base, wherein the studs of each row are shaped and spaced to engagingly and securely fit within the stud receptacles of the mat such that lateral movement between the mat and the connector studs is prevented and wherein at least one of the studs has a locking lip partially surrounding the stud, shaped to interlock with the lip recess of a stud receptacle, for creating a row of upstanding studs adjacent to the stud receptacle edge of the mat.

11. A resilient mat border comprising a border body having a stud slot shaped to engagingly receive and retain a row of upstanding studs attached to a mat, at least one of said upstanding studs having a locking lip, said stud slot having a lip recess shaped to interlock with the locking lip of the upstanding stud and said resilient border having a downwardly tapered top surface.

12. The resilient border of claim 11, wherein the height of the resilient border, when oriented to be attached to upstanding studs attached to the mat, is less than or equal to the thickness of the mat.

13. A resilient mat corner comprising two branches connected at a right angle, wherein each said branch has a stud slot shaped to receive and retain a plurality of linearly aligned upstanding studs attached to a mat, at least one of said upstanding studs having a locking lip, each said stud slot having a lip recess shaped to interlock with the locking lip of the upstanding stud and said resilient corner having a downwardly tapered top surface.

14. The resilient corner of claim 13, wherein the height of the resilient corner, when oriented to be attached to upstanding studs attached to the mat, is less than or equal to the thickness of the mat.

15. The interlocking mat module of claim 9, wherein each of said studs has a uniform cross sectional shape along its longitudinal axis.

16. The interlocking mat module of claim 15, wherein each of said studs is cylindrical.

17. The connector of claim 10, wherein each of said studs has a uniform cross sectional shape along its longitudinal axis.

18. The connector of claim 17, wherein each of said studs is cylindrical.

* * * * *